US006040769A

United States Patent [19]

Payne

[11] Patent Number: 6,040,769

[45] Date of Patent: Mar. 21, 2000

[54] DETECTING DEVICE AND AN ALARM SYSTEM

[75] Inventor: Roger Dennis Payne, Havant, United Kingdom

[73] Assignee: Apollo Fire Detectors Limited, United Kingdom

[21] Appl. No.: 09/292,199

[22] Filed: Apr. 15, 1999

[30] Foreign Application Priority Data

Apr. 16, 1998 [GB] United Kingdom ..... 9808094

[51] Int. Cl.[7] ..... G08B 29/00

[52] U.S. Cl. ..... 340/506; 340/51; 340/538; 340/310.01; 340/310.05

[58] Field of Search ..... 340/511, 506, 340/531, 533, 538, 660, 664, 310.01, 310.05; 324/522, 525

[56] References Cited

U.S. PATENT DOCUMENTS

| | | | |
|---|---|---|---|
| 4,812,821 | 3/1989 | Santy et al. | 340/538 |
| 4,949,359 | 8/1990 | Voillat | 375/106 |
| 5,705,979 | 1/1998 | Fierro et al. | 340/517 |

FOREIGN PATENT DOCUMENTS

| | | |
|---|---|---|
| 0 319 266 A2 | 6/1989 | European Pat. Off. . |
| 0 396 386 A2 | 11/1990 | European Pat. Off. . |

*Primary Examiner*—Daryl Pope

*Attorney, Agent, or Firm*—Cowan, Liebowitz & Latman, P.C.; R. Lewis Gable

[57] ABSTRACT

A fire alarm system has detecting devices and alarm devices connected in parallel across the same supply lines. A control unit (CCU) supplies a first voltage to operate the detecting devices and a second higher voltage to operate the alarm devices. When a fire is detected, signalling means, in the detecting device, produce a change of state signal which causes impedance switching means to switch from a high to a low impedance state. This causes a current drain across the supply lines which is recognized by the CCU as the fire detection signal, which then applies the second voltage to the lines. Voltage responsive means respond to the second voltage to cause the impedance switching means to switch to the high line impedance state. The current drain is thereby reduced to conserve battery power. This avoids large current drains when several detecting devices respond to the fire (e.g. when smoke detectors are triggered by spreading smoke). The voltage responsive means may include threshold voltage means. Additional voltage responsive means cause the impedance switching means to switch to a high impedance state, whenever the line voltage falls below a predetermined level below the first voltage. Circuitry is also described for maintaining the current drain on the supply lines substantially constant, for latching an alarm state, for delaying operation of the impedance switching means to enable the voltage on the supply lines to be switched rapidly between different levels without causing the impedance switching means to be in its low impedance state, and for operating on different polarities.

18 Claims, 3 Drawing Sheets

DETECTING DEVICE AND AN ALARM SYSTEM

Figure 1:
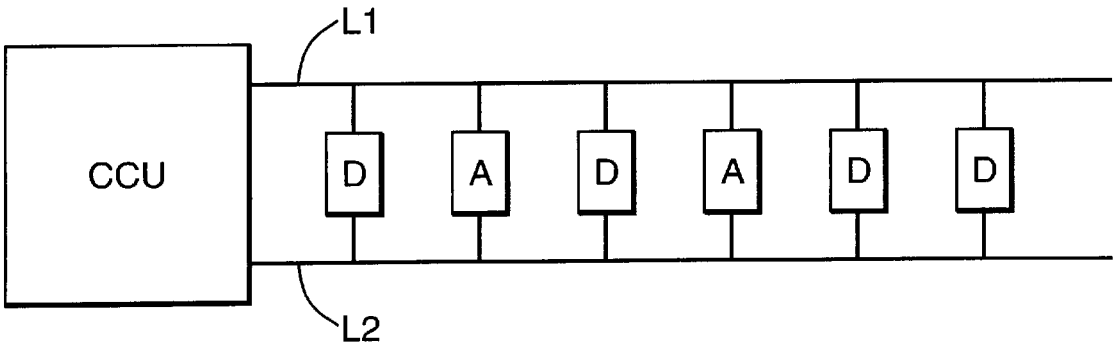

This invention relates to a detecting device and to a control system. The invention can be used in, for example, a control system which includes one or more detecting devices placed in different locations for signalling a change in a parameter, or in an environment and where one or more alarm devices are actuated when the latter change has been signalled. For example, the invention may be used for signalling the onset of a hazardous condition such as a fire and for causing one or more alarm devices to be actuated. It may also be used where something other than a fire is signalled, for example, intrusion into a secure area (as in the case of burglar alarms), and an alarm device is actuated. Hence, although the invention is particularly useful in the field of fire detection, references to such use are not to be construed as limiting The term "fire alarm signal" may often be generally understood but it tends to be used loosely and it may have alternative meanings. In order to reduce and preferably avoid problems over terminology, the following terms are used in this specification with the meanings indicated below.

The term "detecting device" includes a device having signalling means which has both a quiescent state (where there is no change in a condition or environment), and an alarm state (for signalling a change in the condition or environment). The signal may be given manually, for example, as in the case of a manual call point where a button or switch is operated after someone has observed smoke, fire, an intruder, etc. The signal may also be given as a result of the action of a sensor, for example, where a fire is sensed by a flame or smoke sensor and has automatically caused circuitry to change from a quiescent state to an alarm state without human intervention. This "signal" will be called the "change of state signal" or "change signal".

The "change signal" can be used to trigger circuitry in the detecting device which then generates a "detection signal". The "detection signal" could be a change in voltage, or current, or in some other parameter (such as impedance). In the present invention, the "detecting device" includes impedance switching means which responds to the "change signal" so as to effect a change in line impedance (this is explained in more detail below). The "detection signal" is a signal which can be recognised by a "central control unit" (or "CCU"), so that the CCU can then initiate some action. For example, the "CCU" may include a microprocessor which responds to the "detecting signal" to cause an "alarm device" to be actuated to give an "alarm signal". The "alarm signal" is a signal which can be used either as a warning, or to operate something. The warning may be a signal which can be perceived by the senses, such as a visual signal with flashing lights; or an audio signal, such as a bell or siren, or recorded voice; or a combination of these signals, for example, either together, or in some programmed sequence. The "alarm signal" may alternatively operate a device which could, for example, automatically close a door.

A centrally controlled fire alarm system can comprise a CCU for monitoring different groups of fire detecting devices located in different parts of a building. Each group of fire detecting devices can be connected across a common pair of supply lines which are linked back to the CCU which normally applies say 12 volts to the lines to operate the detecting devices. Alarm devices, which are triggered by a higher voltage, can be connected across the same pair of common supply lines and the CCU can respond to a "fire detection signal" to apply say 24 volts to the lines so as cause the alarm devices to give "alarm signals". This system avoids an excessive amount of wiring.

BACKGROUND TO INVENTION

GB-A-1604634 describes such a system in which a control unit normally supplies a nominal 12 volts to the supply lines. In the absence of a fire (when no detecting device has responded), there is hardly any current drain on the lines. When a fire is detected by any of the detecting devices, more line current is drawn by the detecting device and this is seen (by the control unit) as a fire detection signal. The control unit then responds by changing the supply line voltage to a nominal 24 volts, thereby actuating the alarm devices. As the alarm devices are only actuated by a voltage of (e.g.) at least 17 volts, they do not sound an alarm when there is only 12 volts on the line. The detecting devices and the alarm devices can therefore operate on the same line pair to save wiring.

Despite the latter advantage (economy of wiring), there are disadvantages with such a single line pair system. The total current drain is negligible when the system is in its normal operating state (i.e. no fires are detected) and each detecting device draws only a fraction of a milliamp (even if tens of detecting devices are connected on a supply line, the total current drain is extremely small). However, as more and more detecting devices are triggered by a spreading fire, the total current drain will then be appreciable and this adds to the current drain imposed by the actuated alarm devices and it serves no useful purpose. Thus, whilst the system of GB-A-1,604,634 may work adequately when only a few detectors are employed, there is clearly a serious disadvantage when a multiplicity of detecting devices are present in the system and a fire is spreading through a region thereby actuating an increasing number of detecting devices. For example, spreading smoke can quickly actuate many smoke detectors.

There are clearly defined rules for safety that require, for example, that the battery capacity should be capable of sustaining operation of the complete system, in its quiescent state, for twenty four hours and for 30 minutes longer with all detecting and alarm devices actuated. This means that a large battery is required, along with an equally large battery charger (to maintain the battery in good condition). Therefore, the potential current drain imposes the need for an expensive and bulky battery and battery charger system. It also limits design, since bulky components are always a problem to accommodate in casings.

Various prior art attempts to provide fire alarm systems of the two-wire supply type will now be described.

GB-A-1,491,222 discloses an alarm system of the two-wire supply type, wherein detecting devices and alarm devices are connected in parallel across a single pair of lines which are monitored and conditioned by a central control unit. The control unit applies to the lines a d.c. supply with one polarity to which only the detecting devices are responsive (since the alarm devices are fitted with blocking diodes). In the event that the control unit senses a fire detection signal from a detecting device, the control unit applies to the lines a d.c. supply with the opposite polarity whereby the alarm devices are made to operate. This system enables both the detecting devices and the alarm devices to be supplied by the same line pair, and this is economic with wiring. A fire detection signal is signalled by a current flow in the detecting device and circuit means are provided (a blocking diode) to limit current flow in the detecting device when subjected to d.c. with opposite polarity. Whilst this means that a lower capacity standby battery may be used, a disadvantage is that special circuit means (two pole switching) is required in the control unit to reverse the supply polarity and special circuit means is required in the detecting devices to keep their alarm indicators on when the supply transitions through zero when the polarity is reversed. Moreover, the blocking diode would not serve the same purpose in a unipolarity system where the voltage is increased, from say 12 to 24 volts, to operate alarms and there is no change in polarity.

GB-A-2,281,995 discloses an alarm system which has some similarity to that in GB-A-1,491,222 except that (in the event of an alarm), an oscillator cyclically reverses the polarity to the detection and alarm devices so as to allow the presence of a fire detection signal from a detecting device to be periodically verified or determined by the control unit. This is advantageous when it is necessary to operate alarm devices on a second pair of lines, in response to a fire detection signal from a detecting device on a first pair of lines. With this system, it is possible to determine whether or not a detecting device has operated on the second pair of lines, while the alarm devices are being cyclically operated and thereby determine, for example, the spread of fire or smoke. However, the disadvantages attributed to GB-A-1,491,222 also generally apply to GB-A-2,281,995.

British Patent Application 9711745.1 discloses an alarm system in which detecting devices and alarm devices are connected in parallel across a single pair of lines monitored and conditioned by a central control unit. In a preferred embodiment the control unit applies to the lines a current limited first supply condition of 24 volts to which only the detecting devices are responsive. A fire detection signal is generated when a detecting device signal places a resistor across the lines so that the line voltage is reduced to 15 volts. At this voltage, the detecting devices retain their state but do not detect, so that further detecting devices cannot introduce further loads across the line. On registering an alarm from a detecting device the control unit first applies a second supply condition of 12 volts to the lines and secondly and additionally applies a sequence of voltage pulses to the lines which the alarm devices recognise and place themselves into an alarm state. When the second supply condition is applied the detecting devices are still in a "no detect" mode. The alarm devices are reset by applying a third supply condition whereby the supply voltage is reduced to between 5 and 6 volts at which level detecting devices still retain their state. By cyclically resetting the alarm devices, applying the first and second supply condition and sequence of voltage pulses the presence of an alarm signal from a detecting device can be periodically verified or determined by the control unit. A disadvantage of this system is that many common detecting devices such as smoke detectors require the first supply condition to be applied for typically several seconds before they have stabilised sufficient to detect smoke. This severely constrains the temporal operation of the alarm devices when seeking to periodically verify or determine the operation of a detecting device; for instance the output of an audible alarm device would be noticeably interrupted.

In another known alarm system, detecting devices and alarm devices are connected in parallel across a single pair of lines monitored and conditioned by a central control unit and the control unit applies (to the lines) a current limited first supply condition in the range 17 to 24.5 volts to which only the detecting devices are responsive. On registering a fire detection signal from a detecting device the control unit first applies a second supply condition in the range 25 and 31 volts to the lines in which range the alarm devices are made to operate. A sequence of pulses may then be superimposed on the supply whereby detecting devices which recognise the sequence will automatically inhibit themselves from signalling an alarm thereby limiting drain. The first and second supply conditions may be cyclically applied to the lines so that the presence of a fire detection signal from a detecting device to be periodically verified or determined by the control unit. The disadvantage of this system is that the control panel must include circuit means for generating a pulse sequence and detecting devices must include means for decoding the pulse sequence, both of which increase cost and complexity.

OBJECTS OF THE INVENTION

An object of the present invention is to solve the above noted prior art problems with detecting devices and alarm devices which operate on a two wire supply line.

A further object is to provide a solution which has simple and low cost construction, and robust electronics.

Another object is to conserve power, especially battery power, in a system where power is supplied to lines which also carry a detection signal that is recognised by a central control unit, such a detection signal being derived by impedance switching means, connected across the lines and which respond to a signal, given either manually, or as a result of sensor action, to cause a change from a passive high impedance state to an active low impedance state which causes a voltage drop to be recognised as the detection signal, i.e. to initiate some kind of alarm, warning, or control function; the low impedance state otherwise draining power unnecessarily in the alarm state.

A further and related object is to conserve power especially where a plurality of detection devices, such as fire detecting heads, are triggered simultaneously so that each low impedance does not provide an excessive and cumulative power drain on the lines.

SUMMARY OF INVENTION

The invention provides a detecting device for connection to a pair of current supply lines to which at least one alarm device and a control unit is also connected, the control unit providing operating current on the supply lines for the detecting and alarm devices. The supply lines are also used to signal a current drain in the detecting device as a fire detection signal. The detecting device operates when a first voltage is present on the supply lines and the alarm device operates when a second voltage, which is higher than the first voltage, is present on the supply lines. The detecting device includes signalling means for producing a change of state signal from a quiescent state to an alarm state when a change in a condition or environment occurs, no such change occurring in the quiescent state. Terminals are provided for connection to said supply lines. The detecting device also has impedance switching means with high and low impedance states across said terminals. The impedance switching means is normally in its high impedance state when the signalling means is in its quiescent state, but it responds to the change of state signal from the signalling means so as to switch to the low impedance state, the low impedance state increasing current drain on the supply lines so that it is recognisable as the fire detection signal. Voltage responsive means are included which respond to said second voltage so as to cause the impedance switching means to switch to a high impedance state so that the line impedance across said terminals is increased so as to reduce the current drain and thereby conserve power.

One of the advantages of the invention is that the line impedance of the detecting device is positively switched between high and low states to give the fire detection signal, i.e. when the change of state signal occurs (it can also be positively switched between its low and high states e.g. to check the alarm status of fire detecting devices). The line impedance can therefore be specifically designed to suit circuit requirements (e.g. it is easy to change the value of a resistor in series with a switch). The line impedance is also automatically increased after (e.g.) a fire has been detected and the alarm devices have been actuated, so that the detecting device then draws a much reduced current, thereby avoiding adding an unnecessary load on the battery. Furthermore, the detecting device is autonomous in operation because it contains the necessary circuitry to operate the impedance switching means for increasing line impedance. This circuitry is simple, reliable and inexpensive. Furthermore, detecting devices can be made responsive to one or both supply polarities and can detect a fire when alarm devices are operating. This is useful because it enables, for example, discrimination of detecting devices and operation of different types of alarm devices according to the type of detecting device signalling the alarm state.

The detecting device preferably includes threshold voltage means having a threshold higher than its nominal working voltage (i.e. 17 volts threshold voltage for 12 volts working), but lower than the nominal voltage of the alarm devices (e.g. 24 volts). The impedance switching means then operates automatically whenever the line voltage is above the threshold. If the line voltage subsequently falls, the threshold voltage means can then cause the impedance switching means to change back from the high to the low impedance state and to present a fire detection signal to the CCU. This is also advantageous if the line voltage is switched purposely between high and low values so as to cause the alarm devices to be operated in one time period and detection devices to be monitored by the CCU in another time period, e.g. to ascertain the spread of fire (from the number of pairs of lines with triggered detecting devices).

Preferably, additional voltage responsive means are used to cause the impedance switching means to switch from its low to its high impedance state whenever the line voltage is below a predetermined voltage (say 7 volts) and a change of state signal is latched. When connected to a current limited supply, this avoids a heavy current drain by a plurality of actuated detecting devices that could otherwise cause the line voltage to drop below a value (say 3 volts) at which the alarm latch in a detecting device can no longer be maintained.

Preferably, active circuit means are provided for maintaining the current drain on the supply lines substantially constant when the impedance switching means is in its low impedance state. This enables the alarm current to be limited to a predetermined value (e.g. 22 mA).

The detecting device preferably includes latching means for latching an alarm state and for maintaining the alarm state as long as the voltage on the supply lines remains above a predetermined level (e.g. 3 volts). The latching means can then be automatically reset by reducing the voltage on the supply lines below the predetermined level (3 volts). An authorised person can purposely drop the line voltage below this value to reset all detecting devices either after a fire has been extinguished or during a test.

Preferably, circuitry is included for maintaining current substantially constant through the latching means in the latched state. For example, a constant low current drain in a voltage range of say 3–7 volts enables the detecting devices to be operational, without the line voltage dropping below the level at which the latching means is automatically reset. (Where the detecting devices have light indicators, such as diodes, a substantially constant low current will maintain the light outputs to indicate the alarm states.)

In a modification, rectification means are provided to enable the detecting device to be connected to a supply of either polarity, all functions of the detecting device, including voltage (threshold) sensing and impedance switching in the alarm state, being operable with either polarity.

In a further modification, charge storage means delays operation of the impedance switching means so as to enable a rapid transition from a low operating voltage range (say 3–7 volts) to a high voltage range (say 16–33 volts), without causing a low impedance state to be applied across the line so as to minimise or eliminate current surges during the transition when many detection devices have been triggered.

Preferably, an indicator which draws very low current, such as an LED in series with a resistor, is responsive to the latching means to provide indication of alarm state. It is advantageous to provide an indication of an alarm latched state so that the respective detecting devices can be identified, for example when the building is inspected during a fire alarm, either when the alarm devices are turned off and when they are turned on.

Preferably, a low voltage threshold device, such as a zener diode, is connected in series with the indicator means whereby an optional indicator (e.g. an LED) can be connected across the threshold device for providing remote indication of the alarm state without significantly changing the impedance of the switching device.

DESCRIPTION OF DRAWINGS AND PREFERRED EMBODIMENTS

Figure 4:
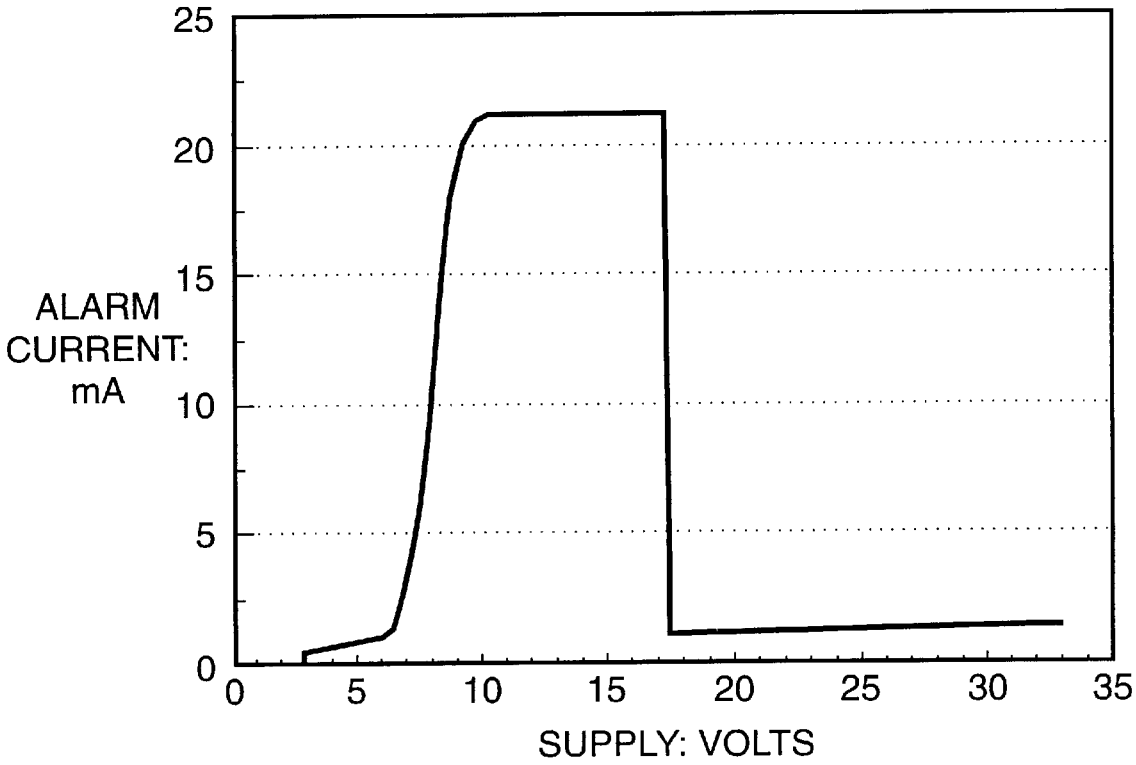
Figure 2:
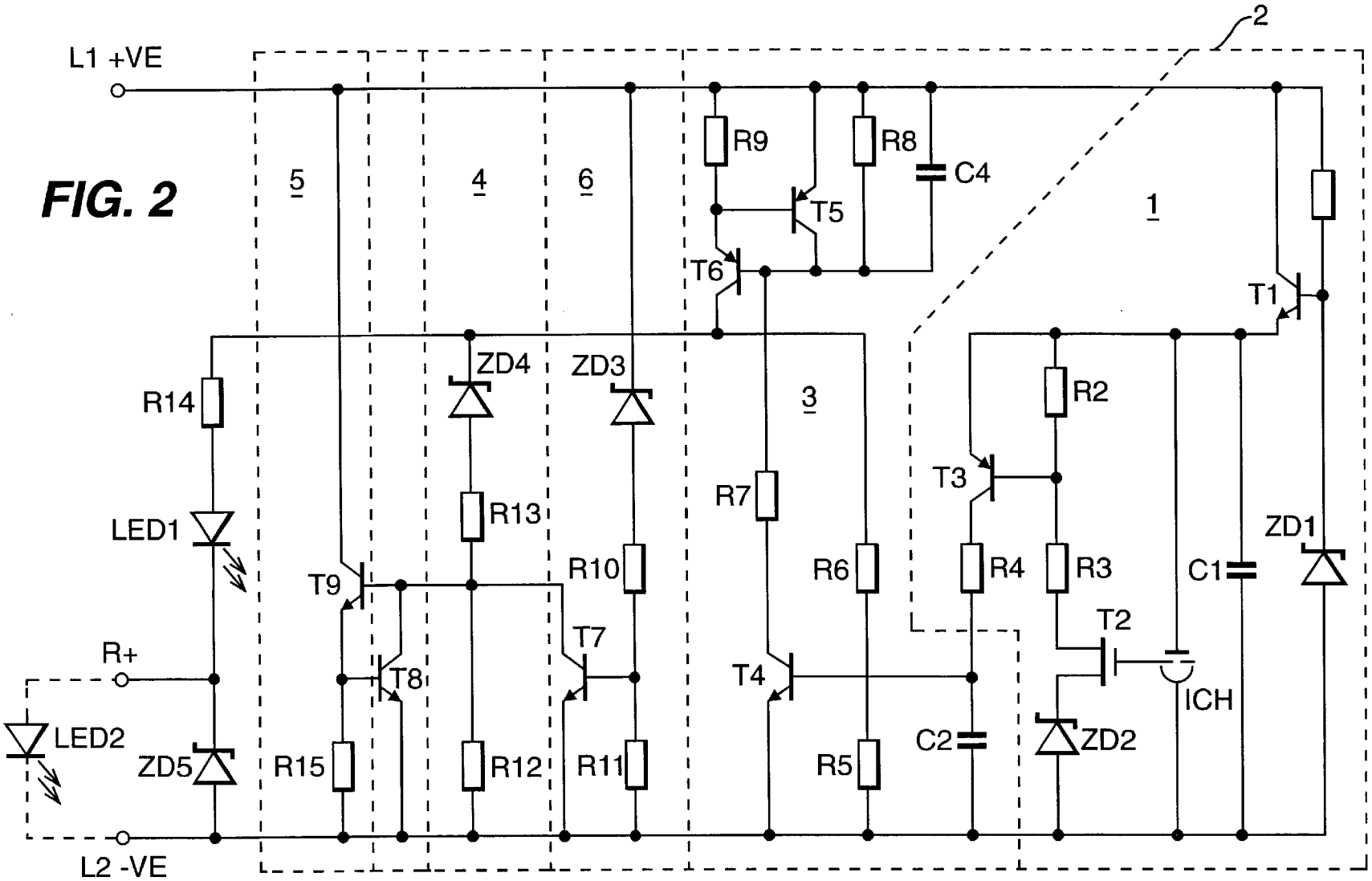
Figure 3:
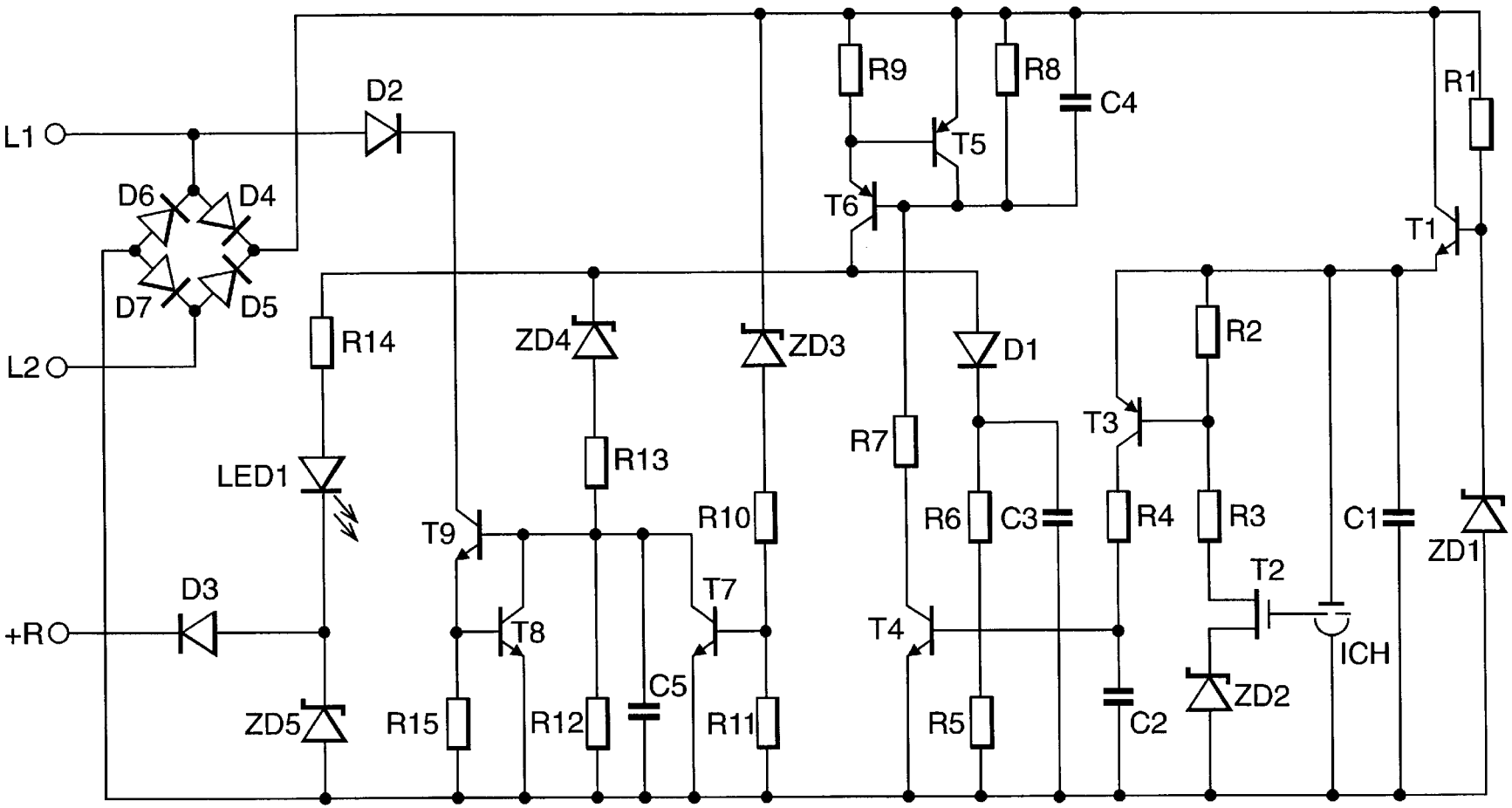

Embodiments of the invention will now be described with reference to the accompanying drawings, in which:

FIG. 1 is a block schematic diagram of a centrally controlled fire detecting system FIG. 2 is a circuit diagram of a first embodiment of the invention, FIG. 3 is a circuit diagram of a second embodiment of the invention, and FIG. 4 is a graph for illustrating circuit operation.

FIG. 1 is a block schematic diagram of a centrally controlled fire detecting system comprising central control unit CCU, a pair of supply lines L1,L2 and a series of fire detecting devices D and alarm devices A connected in parallel across lines L1,L2. The system is of the two-wire supply type where, for example, detecting devices D draw negligible line current in a quiescent state when there is no detection signal and alarm devices A are not actuated. In the event of a fire, the impedance of the respective detecting device D decreases, thereby drawing more line current. This increase in line current (which is the "fire detection signal") is detected by central control unit CCU which then increases the line voltage above a value at which alarm devices A are actuated. The detecting devices D normally operate on a lower voltage.

Embodiments of the invention are now described below with reference to FIGS. 2 and 3, which each illustrate the circuitry of a detecting device D in greater detail. The detecting device D, may be in the form of a detachable head that can be fitted to a holder having terminals connected to a two-wire supply line. The head includes terminals which make contact with the terminals in the holder and which supply current to the detecting device. The head also includes sensing means which respond to a change in a parameter or environment so as to provide a sensing signal and impedance switching means responsive to the sensing signal so as to reduce the impedance across the terminals and thereby increase current drain on the supply lines, the current drain being recognisable as the fire detection signal. The head normally presents a high impedance across the terminals when the first voltage is present and when there is no change in the parameter, or environment sufficient to provide the sensing signal. (Instead of a detecting head fitted with a sensor, the detecting device may be in the form of a manual call point, for example, including signalling means, such as a switch, which is actuated by breaking a glass cover).

The circuitry of an alarm device A is not described in detail, since this can be of known construction (for example as described in GB-A-1604634). However, it is significant to note that the alarm device A operates on a voltage condition on the supply lines L1, L2 which differs from the voltage condition normally present to operate detecting devices D. The alarm condition of alarm devices A may be latched, after actuation, so that alarm device continues to give an alarm in the event that the voltage falls below its alarm threshold voltage of (e.g.) 17 volts. In preferred embodiments, the alarm condition is not latched and it is only sustained in operation by the supply voltage being above the alarm threshold voltage of (e.g.) 17 volts.

Reference will now be made to Table 1 and to FIG. 4 before describing the circuits of FIGS. 2 and 3.

TABLE 1

| Range | Voltage | Detecting devices | Alarm Devices |
|---|---|---|---|
| A | 9–33 | Capable of detection. Quiescent current <100$\mu$A | |
| B | 17–33 | | On |
| C | 0–17 | | Off |
| D | 7–16 | Alarm latch maintained. Alarm current limited to 22mA | |
| E | 16–33 | Capable of detection. Alarm latch maintained. Alarm current limited to 1 mA | |
| F | 3–7 | Possibly capable of detection. Alarm latch maintained. Alarm current limited to 1 mA | |
| G | 0–3 | Reset | |

Table 1 shows different voltage ranges A–G and it indicates also the operating state of the detecting devices and the alarm devices in a preferred embodiment.

Voltage range A, 9–33 volts, is a range over which the detecting devices are operable. When no fires are detected they all have a high line impedance and hence each draws a fraction of a milliamp (for example, <100 microamps in a quiescent state).

Voltage range B, 17–33 volts, is a range over which the alarm devices are operable. For example, they may be actuated by the line voltage exceeding 17 volts. As the detecting devices operate at say 12 volts, the alarm devices are not normally operated.

Voltage range C, 0–17 volts, represents the quiescent state of the alarm devices, since they require at least 17 volts before operating.

Voltage range D, 7–16 volts, is a voltage range in which a detecting device can be actuated so that a signal from a sensor causes a switch to operate, thereby causing the line impedance to drop, increasing line current, and be seen (by the control unit) as a fire detection signal (this current increase is limited to 22 mA in the described example).

Voltage range E, 16–33 volts, is a range in which the detecting device is still operational, the sensing circuit being capable of responding to a change in the condition being monitored and the latching circuit capable of latching a change of state signal from the sensing circuit. In the quiescent state, the line impedance of the detecting device is very high and the current taken from the line is a fraction of a milliamp (for example a 100 microamps). When a fire is detected, the detecting device is inhibited from presenting a low line impedance (a fire detection signal) by the voltage threshold (16 volts), the current drawn being limited to approximately 1 mA or less. A detector which has detected a fire in a voltage range E will present a low line impedance when the supply is changed to voltage range D.

Voltage range F, 3–7 volts, is a range where the line voltage has fallen and the current drain on the line is limited to 1 mA. This can occur when more and more detecting devices are triggered and the line voltage falls since it cannot be maintained by a supply (12 volts) providing a limited line current. The detecting device has voltage responsive means which detects a lower voltage below 7 volts and causes a high impedance to be placed across the supply lines to limit current to no more than 1 mA. This avoids a problem where the triggering of more and more detecting devices could lead to such a voltage drop on the supply line that it falls below a minimum (3 volts) at which point the alarm latch falls out and the circuit automatically resets. The voltage range 3–7 volts can be selected when an authorised person wishes to turn off the alarm devices when they are all sounding after a fire has been detected. This could be done by the Fire Service, for example, when called to the scene of a fire and when the alarm sounders are turned off. It is important, in this case, that the alarm condition remains latched in the CCU, so that the system is not reset until it is safe to do so.

Voltage range G, 0–3 volts, is the lowest line voltage condition, which may be imposed, by an authorised person, in order to reset all detecting devices in the alarm system.

Turning now to FIG. 4, this shows a graph of line current (mA) against line voltage (volts) for a detecting device. In the first region, 0–3 volts, none of the detecting (nor alarm) devices are operational. This is only the region which enables detecting devices to be reset after they have been latched into an alarm state following the detection of a fire. In the region of 3–7 volts, the line current is limited to about 1 mA because the impedance of the detecting devices is high due to the operation of voltage sensing means. The steep part of the graph, between about 7 and 9 volts occurs because the maximum fire detection signal is limited to about 22 mA. However, as more and more detecting devices are placed in an alarm state, they cannot all draw 22 mA from a current limited supply and the line voltage will fall rapidly, as a result. The region between about 9 and 16 volts is the normal region in which the detecting device has a reduced line impedance in order to generate the sensing signal (22 mA). For voltages above 16 volts, voltage sensing means within the detecting device operate so as to change the low impedance to a high impedance across the supply lines. This immediately causes the line current to drop to about 1 mA and this can be maintained substantially constant over the voltage range of about 17–33 volts, by active circuitry in the detecting device. The alarm devices will be actuated at about 17 volts and these will draw current from the supply (which could range from a few milliamps to several amps) depending on the type of device.

A description will now be given of two preferred embodiments of the invention where FIG. 2 is a circuit diagram of a detecting device which is designed to operate on 12 volts and to cooperate with the control unit so as to cause alarm devices to be actuated by applying 24 volts to the supply lines. FIG. 3 is a circuit diagram of a detecting device with a modification intended to enable operation on either polarity being applied to the input terminals and containing some other modifications to improve performance.

FIG. 2 is a circuit diagram of a first embodiment of the invention where sensing means 1 includes an ionisation smoke detector ICH. The sensing means 1 is largely indicated by the broken lines 2 and it includes resistors R1, R2, R3, R4, zener diodes ZD1, ZD2, ionization chamber ICH, and transistors T1, T2, T3. The value of ZD1 is chosen to produce a stabilised voltage across the ionisation chamber ICH at supply voltages greater than the minimum voltage in Range A (e.g. 9–33 volts). When the density of smoke in the ionisation chamber exceeds a preset level, determined by T2 and ZD2, transistor T3 is turned on thus providing a positive going sensing signal from the sensing means 1. The sensing means 1 may be replaced by other types of known sensor circuits, including switch contacts of e.g. a manual call point, which would not require voltage stabilisation. Capacitors C2, C4, resistors R5, R6, R7, R8, R9, and transistors T4. T5 and T6 act together, as latching means 3, to latch any sensing signal from the sensing circuit 1, T6 being turned on when the circuit is in the latched state. Component values are selected for low current consumption in the latched state and the value of R9 is selected to limit the collector current of T6 to a value not significantly greater than that to turn on light emitting diode LED1. R9, T5 and T6 act together to maintain the output current substantially constant at a voltage in the voltage ranges 7–33 volts. Component values are further selected to cause the latch to reset when the supply voltage is significantly less than the lower limit of the voltage range F, 3–7 volts.

Zener diode ZD4, resistors R12, R13 act as a threshold voltage responsive means 4 with component values selected to turn on transistor T9 when transistor T6 is turned on and the supply voltage exceeds the lower limit of the voltage range D, 7–16 volts. When transistor T9 is turned on, current can flow from terminal L1 through transistor T9 (collector emitter) and the low impedance resistor R15 to terminal L2, the current being made substantially constant (at say 22 mA) by T8 providing negative feedback to the base of T9. T9 and R15 are generally shown as impedance switching means 5.

Zener diode ZD3, resistors R10, R11 and transistor T7 act as threshold voltage sensing means 6 with values selected to cause transistor T7 to turn on when the supply voltage exceeds the upper limit of the second voltage range B (17 volts). When T7 is turned on the current supplied via resistor R13 to the base of transistor T9 is shunted through T7 thereby turning T9 off and changing the impedance presented across the supply from a low impedance to a high impedance.

It is to be noted that so long as the change of state signal (from the sensor circuit) is latched, the changes from low impedance to high impedance are reversible in accordance with the condition of the supply voltage. This enables the line voltage to be cyclically switched from 12 to 24 volts for the purpose of causing the alarm devices to produce a temporal alarm signal. It also allows the line voltage to be switched from 24 to 12 volts for a short time, just sufficient for the central control unit (CCU) to determine or to confirm that a detecting device is in an alarm state.

Zener diode ZD5 is connected in series with LED1 and across terminals R+ and L2 (−ve) to facilitate the employment of a remote indicator LED2, whereby when LED2 is connected the current taken by the detector and LED2 together is not significantly different from that taken by the detector alone. The Zener voltage of ZD5 being selected to be slightly greater than the forward bias voltage of the remote LED2.

FIG. 3 is a second embodiment of the invention incorporating a number of additional but optional components. Diodes D4, D5, D6 and D7 allow the detecting device to be connected to a supply of either polarity. Accordingly, the central control unit can change the supply polarity. In this case, the fire detection signal (low impedance) can be produced by the detection device in either polarity (bipolar). The collector of T9 may be connected to the supply terminal L1 via diode D2 so that when L1 is negative the detecting device presents a high impedance at all supply voltages even if the circuit is latched (unipolar). Bipolar and unipolar detection devices may be used with unipolar alarm devices of both polarities distinguished by different alarm sounds for the purpose of producing alarm signal according to the type of detection device that has operated, unipolar or bipolar (e.g. manual call point or smoke detector). Diode D1 and capacitor C3 prevent the alarm latch from resetting in the event that there is a short interruption in the supply during a reversal of the supply polarity. Capacitor C5 slows down the rate of increase of the voltage on the base of T9. This is advantageous in that it allows the supply voltage to be quickly switched from a voltage less than the minimum of the voltage range D (e.g. 7–16 volts) to a voltage greater than the minimum of the second voltage range B (e.g. 17–33 volts) without T9 turning on, thereby minimising the current drain during a supply transition through the voltage range D, especially if several detectors are in the alarm state and the supply is not current limited during transition.

Diode D3 may be incorporated to prevent damage to other circuit components in the event that a positive supply is purposely or otherwise connected to the R+ terminal.

Some examples of how the invention may be employed will now be described.

In a first example, a fire alarm system employs a plurality of detecting devices (according to the invention) which are each responsive to smoke and able to register and latch an alarm condition in the event that smoke level exceeds a preset level when the detecting device is supplied with a voltage in the range 9–33 volts. As the detecting devices are originally normally supplied with a nominal 12 volts from a 25 mA current limited supply, they are operating in the 7–16 volt range where the line impedance of each detecting device is reduced, when a fire is detected, so as to impose a (constant) 22 mA current drain on the supply lines, which is recognised by the control unit, as a fire detection signal. The control unit then imposes the 24 volts on the supply lines. The detecting devices are then operating in the 16–33 volt range, where the line impedance of each detecting device is high in order to reduce current drain to about 1 mA. This is sufficient to maintain light output from the LEDs, so that detecting devices in the alarm condition can be identified. For example, this could be done by an authorised person or a Fire Officer examining a scene where fire detection has occurred and it is necessary to ascertain where the detecting devices have been actuated. The system uses a plurality of alarm devices which sound an alarm signal above the threshold voltage of 17 volts, but are inoperative below this 17 volt threshold. In the voltage range of 3–7 volts, the line impedance of each detecting device is high and is designed to cause a current drain of about 1 mA, which is sufficient to maintain a light output from the light emitting diodes so that the detector devices (in the alarm state) can be identified. In this example, even if twenty detecting devices have been actuated, their combined current drain would amount to no more than 25 mA, which is equivalent to only marginally more than one detecting device being in the alarm state. The supply current limit in the voltage range 3–16 volts may be less than 25 mA and less than the current drawn by a detection device producing a fire detection signal (22 mA) provided that there is sufficient current available to turn on the alarm indicators of all the detection devices that can simultaneously signal an alarm.

In a second example, the control unit alternately conditions the supply lines with a low impedance supply, providing a voltage above the threshold voltage of the alarm devices, and a current limited supply, which provides a voltage less than the alarm threshold of the alarm devices and preferably within the voltage range in which the control unit can determine whether or not a detecting device is in a high or low impedance state. The alternating conditioning is applied to pairs of lines on which a detector has operated for the purpose of producing a temporal alarm signal, or to a pair of lines on which a detector has not operated, for the purpose of producing a temporal alarm signal, or for the purpose of periodically monitoring a fire detection signal.

In the second example, because detecting devices can still detect a fire when the alarm devices operate, there will be virtually no delay in the low impedance state of the detecting devices being presented across the supply lines when they are conditioned to enable the low impedance state to be detected by the control unit. Therefore, the lines need only be supply conditioned for detecting a low impedance detector for a time not significantly longer than the time required by the control unit to discriminate between low and high impedance states. This time can be made sufficiently short that the interruption in the output of an alarm device is not normally noticeable or perceptible.

In a third example (FIG. 3) the control unit has means for reversing the polarity of the voltage applied to the pair of lines, either in response to a detector changing to an alarm state, or for any other reason, so as to cause the operation of further alarm devices, the further alarm devices being polarity sensitive. Therefore, polarity sensitive and threshold voltage alarm sensitive devices can be combined in the system whereby either type of alarm device can be selectively operated to provide, for example, different temporal alarms. The two types of alarm device can be conveniently incorporated in one housing (e.g. detector mounting base) and have circuit components in common.

In a fourth example, smoke sensors and manual call points are connected in the control unit. The smoke sensors are unipolar and therefore only capable of generating a fire detection signal in a first polarity and the manual call points are bipolar and therefore capable of generating a fire detection signal in first and second polarities. Two types of unipolar alarm devices are also connected to the control unit on the same lines. The first type of alarm device operates only in the first polarity when the supply is in range B and produces a continuous alarm signal when activated. The second type of alarm device operates only in the second polarity when the supply is in range B and produces an alternating alarm signal when activated. In the standby condition the control panel monitors the smoke sensors and manual call points in the first voltage in the first polarity. When the fire detection signal is received, the control panel switches the supply to the first voltage in the second polarity. If the fire detection signal is still present the panel switches the supply to a voltage in the range B in the first polarity on all lines and thereby sounds a continuous "evacuate" alarm throughout the building. If the fire detection signal is not still present, the panel switches the supply to a voltage in the range B in the second polarity on all other lines and thereby produces an alternating "alert" signal in the areas covered by those lines throughout the building.

Clearly, there will be other ways in which the system can operate, depending on the number of devices which draw current from the supply lines and the way in which the control unit is programmed to operate. However, as the detecting device is largely autonomous, it adapts itself to circuit operation.

I claim:

1. A detecting device for connection to a pair of current supply lines to which at least one alarm device and a control unit is also connected, the control unit providing operating current on the supply lines for the detecting and alarm devices, the supply lines being used to signal a current drain in the detecting device as a fire detection signal, the detecting device operating when a first voltage is present on the supply lines, the alarm device operating when a second voltage, which is higher than the first voltage, is present on the supply lines; the detecting device comprising:

signalling device for producing a change of state signal from a quiescent state to an alarm state when a change in a condition or environment occurs, no such change occurring in the quiescent state;

terminals for connection to said supply lines;

a switch having high and low impedance states, said switch being connected across said terminals, said switch normally being in its high impedance state when the signalling device is in its quiescent state, but responding to said change of state signal from the signalling device so as to switch to the low impedance state, the low impedance state increasing current drain on the supply lines so that it is recognisable as the fire detection signal; and a voltage responsive device which responds to said second voltage so as to cause said switch to switch to a high impedance state so that the line impedance across said terminals is increased so as to reduce the current drain and thereby conserve power.

2. A detecting device according to claim 1, wherein said switch and an impedance are arranged in a low impedance path across said terminals; the voltage responsive device operating the switch so as to disconnect the low impedance path from said terminals when the second voltage is present.

3. A detecting device according to claim 2, wherein the voltage responsive device has a threshold higher than the first voltage and lower than the second voltage so that the impedance switching device is operated when the line voltage rises above the threshold.

4. A detecting device according to claim 3, further including an active circuit coupled to said switch for maintaining the current drain on the supply lines substantially constant when said switch is in the low impedance state.

5. A detecting device according to claim 1, further including a latch for latching an alarm state, once the signal from the signalling device has been generated, so that the alarm state is maintained as long as the voltage on the supply lines remains above a predetermined minimum level which is below the level of the first voltage.

6. A detecting device according to claim 5, wherein the latch includes circuitry for reducing current and maintaining it substantially constant in the latched state and for enabling the latch to be automatically reset when the voltage on the supply lines has fallen below said predetermined minimum voltage level.

7. A detecting device according to claim 6, wherein an additional voltage responsive device causes said switch to switch to a high impedance state, whenever the voltage across said terminals falls below a second predetermined level below the first voltage but above the predetermined minimum voltage level, and the latch is in its latched state.

8. A detecting device according to claim 7, further including a charge storage device for delaying operation of said switch so as to enable the voltage on the supply lines to be switched rapidly from a level, which is below the second predetermined level, to a level at which the alarm device operates so as to minimise or avoid the period within which the supply line voltage level is such as to cause said switch to be in its low impedance state.

9. A detecting device according to any of claim 8, further including an indicator responsive to said latch to provide an indication of the alarm state.

10. A detecting device according to claim 9 further including a low voltage threshold device in series with indication means and an optional indicator connected across the voltage threshold device for providing remote indication of the alarm state, said indicator having substantially the same operative current, the operating voltage of said optional indicator being less than the threshold voltage of said threshold device so that the line impedance of the detecting device is substantially unaffected by the connection of said optional indicator.

11. A detecting device according to claim 1, including a rectifier connected across the terminals to enable the detecting device to be connected to a supply of either polarity.

12. A detecting device according to claim 11 further including a diode connecting one terminal to said switch so that when said terminal has a given polarity, the detecting device presents a high impedance at all working voltages on the supply lines, even if an alarm state has been latched.

13. A control system including at least one pair of supply lines, a central control to which the supply lines are connected, one or more detecting devices connected across the pair of supply lines and normally operating with a first voltage on said lines, each detecting device being in accordance with claim 1 and one or more alarm devices which are actuated when a second voltage, higher than the first voltage, is present on the supply lines; the central control responding to the fire detection signal so as to place the second voltage on the supply lines.

14. A control system according to claim 11, in which the central control unit operates so as to limit the maximum current drain on the line so that the line voltage will fall, as more detecting devices are caused to generate fire detection signals, due to reduced line impedance, the fall being to a voltage less than a predetermined level below the first voltage.

15. A system according to claim 14, including a cyclical switch for cyclically switching the line voltage from the first to the second voltage and vice versa, the time of application of the first voltage being at least sufficient for the central control unit to determine the state of a detecting device.

16. A system according to claim 15 in which:

the low impedance state of one or more detecting devices of a first type is realizable only with a first supply polarity;

the low impedance state of one or more detecting devices of a second type is realizable in first and second supply polarities;

one or more alarm devices of a first type are operable in the first polarity only and one or more alarm devices of a second type are operable in the second polarity only;

the central control unit being supplied with a further switch from the first line voltage in first polarity to the first line voltage in second polarity so as to determine which type of detecting device is in an alarm state after first detecting a low impedance state with the first line voltage in the first polarity, and another switch for switching from the first line voltage in the second polarity to the second line voltage in a polarity according to the type of detecting device determined to be in alarm and so causing the type alarm devices operated to be according to the type of detecting device determined to be in alarm.

17. A system according to claim 16, the central control unit being provided with manual or automatic selector for selecting the first line voltage in the second polarity so that only detection devices of the second type can signal an alarm.

18. A detecting device for connection to a pair of current supply lines to which at least one alarm device and a control unit is also connected, the control unit providing operating current on the supply lines for the detecting and alarm devices, the supply lines being used to signal a current drain in the detecting device as a fire detection signal, the detecting device operating when a first voltage is present on the supply lines, the alarm device operating when a second voltage, which is higher than the first voltage, is present on the supply lines; the detecting device comprising:

signalling means for producing a change of state signal from a quiescent state to an alarm state when a change in a condition or environment occurs, no such change occurring in the quiescent state;

terminals for connection to said supply lines;

impedance switching means having high and low impedance states across said terminals, the impedance switching means normally being in its high impedance state when the signalling means is in its quiescent state, but responding to the change of state signal from the signalling means so as to switch to the low impedance state, the low impedance state increasing current drain on the supply lines so that it is recognisable as the fire detection signal; and voltage responsive means which respond to said second voltage so as to cause the impedance switching means to switch to a high impedance state so that the line impedance across said terminals is increased so as to reduce the current drain and thereby conserve power.

* * * * *